US006900007B1

(12) United States Patent
Mura, Jr. et al.

(10) Patent No.: US 6,900,007 B1
(45) Date of Patent: May 31, 2005

(54) SILVER HALIDE PHOTOGRAPHIC ELEMENT AND PROCESS

(75) Inventors: Albert J. Mura, Jr., Rochester, NY (US); Gary M. Russo, Webster, NY (US); Shari L. Eiff, Rush, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/910,817

(22) Filed: Aug. 4, 2004

(51) Int. Cl.[7] ..... G03C 1/08; G03C 7/26; G03C 7/32

(52) U.S. Cl. ..... 430/558; 430/551

(58) Field of Search ..... 430/551, 558

(56) References Cited

U.S. PATENT DOCUMENTS 6,071,686 A 6/2000 Cowan et al.
6,348,306 B1 2/2002 Mura

*Primary Examiner*—Geraldine Letscher
(74) *Attorney, Agent, or Firm*—Arthur E. Kluegel

(57) ABSTRACT

A photographic element comprises a light-sensitive silver halide emulsion layer having associated therewith (a) a 1H-pyrazolo[1,5-b][1,2,4]triazole dye-forming coupler; (b) a sulfonamide compound free of aromatic substituents directly linked to the sulfonamide nitrogen or sulfur atoms and (c) a dialkoxy substituted aromatic compound.

14 Claims, No Drawings

SILVER HALIDE PHOTOGRAPHIC ELEMENT AND PROCESS

FIELD OF THE INVENTION

The invention relates to an imaging process and a photographic element containing a light-sensitive silver halide emulsion layer comprising a 1H-pyrazolo[1,5-b][1,2,4] triazole dye forming coupler associated with a stabilizer set including a simple alkyl sulfonamide compound that reduces fading of the formed image dye as a result of light exposure.

BACKGROUND OF THE INVENTION

In a silver halide photographic element, a color image is formed when the element is exposed to light and then subjected to color development with a primary aromatic amine developer. Color development results in imagewise reduction of silver halide and production of oxidized developer. Oxidized developer reacts with one or more incorporated dye-forming couplers to form an imagewise distribution of dye.

The image dyes that are formed by a coupler during processing have a tendency to fade over time as a result of exposure to light, heat and humidity. As the image dyes of an element fade, this results in deterioration of the image over time. In addition, since the various image dyes may not fade at the same rate, an apparent change in image color may result. Such change is particularly noticeable in the case of magenta image dye fading.

A variety of dye-forming coupler types have been used in photographic materials. Among the known dye-forming couplers are cyclic azoles such as pyrazolotriazoles. These couplers contain bridgehead nitrogen 5,5 fused ring systems and include such couplers as 1H-pyrazolo[5,1-c][1,2,4] triazoles and 1H-pyrazolo[1,5-b][1,2,4]triazoles. These couplers form magenta dyes in response to exposure to green light.

A significant disadvantage of pyrazoloazole couplers is fading of the dyes formed from them by photographic processing due to extended exposure to low levels of light. Compounds which are included in photographic elements to reduce image dye fading are known as light stabilizers. Inclusion of such stabilizers in color photographic materials at a location near to the location of the image dye can reduce the deterioration of the dye images. This is true for dyes formed from pyrazoloazole couplers. U.S. Pat. Nos. 5,236,819 and 5,082,766 and German Published Patent Application OS 4,307,194 describe the use of certain stabilizers with pyrazoloazole couplers to improve their dye stability. The known stabilizers have not been entirely satisfactory in reducing the rate of fading of the image dyes. U.S. Pat. Nos. 5,561,037 and 6,071,686 suggest the use of an aromatic sulfonamide in combination with other specified stabilizers such as cyclic aminosulfones or alkoxyaromatics as useful anti-fade stabilizers for pyrazoloazoles. The aromatic sulfonamides are useful but difficult and expensive to manufacture.

It would be desirable to improve the light stability of image dyes derived from 1H-pyrazolo[1,5-b][1,2,4]triazole dye forming couplers using materials more readily manufactured than the known aromatic sulfonamides, and thereby retain an accurate color rendition of the image for a longer period of time.

SUMMARY OF THE INVENTION

The invention provides a photographic element comprising a light-sensitive silver halide emulsion layer having associated therewith (a) a 1H-pyrazolo[1,5-b][1,2,4]triazole dye-forming coupler; (b) a sulfonamide compound free of aromatic substituents directly linked to the sulfonamide nitrogen or sulfur atoms and (c) a dialkoxy substituted aromatic compound. The invention also provides an imaging process employing the element of the invention.

The element and process of the invention provide an improvement in the light stability of image dyes derived from 1H-pyrazolo[1,5-b][1,2,4]triazole dye forming couplers using materials more readily manufactured than the known aromatic sulfonamides.

DETAILED DESCRIPTION OF THE INVENTION

The invention is generally as described above. The coupler useful in the invention is a 1H-pyrazolo[1,5-b][1,2,4] triazole. Such couplers typically produce magenta dyes upon coupling with a p-phenylenediamine developer during processing of the silver halide element. Preferred couplers are pyrazolotriazoles represented by Formula M:

M

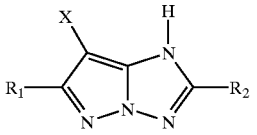

wherein:

$R_1$ is hydrogen or a substituent group;

$R_2$ is a substituent group; and

X is hydrogen or a coupling-off-group, provided that X, $R_1$ and $R_2$ contain a sufficient number of carbons to immobilize the coupler in the emulsion layer. In preferred couplers represented by Formula M, $R_1$ is hydrogen or a substituent; $R_2$ is a ballast group of 6 or more aliphatic carbon atoms; and X is hydrogen or a coupling-off group.

Examples of suitable $R_1$ substituent groups comprise groups including (cyclo)alkyl, such as methyl, ethyl, n-propyl, n-butyl, t-butyl, trifluoromethyl, tridecyl, cyclohexyl, cyclopentyl, or 3-(2,4-di-t-amylphenoxy) propyl; alkoxy, such as methoxy or ethoxy; alkylthio, such as methylthio or octylthio; aryl, aryloxy or arylthio, such as phenyl, 4-t-butylphenyl, 2,4,6-trimethylphenyl, phenoxy, 2-methylphenoxy, phenylthio or 2-butoxy-5-t-octylphenylthio; heterocyclyl, heterocyclyloxy and heterocyclylthio, each of which contain a 3 to 7 membered heterocyclic ring composed of carbon atoms and at least one hetero atom selected from oxygen, nitrogen and sulfur, such as 2-furyl, 2-thienyl, 2-benzimidazolyloxy or 2-benzothiazolyl; cyano; acyloxy, such as acetoxy or hexadecanoyloxy; carbamoyloxy, such as N— phenylcarbamoyloxy or N-ethylcarbamoyloxy; silyloxy, such as trimethylsilyloxy; sulfonyloxy, such as dodecylsulfonyloxy; acylamino, such as acetamido or benzamido; anilino, such as phenylanilino or 2-chloroanilino; ureido, such as phenylureido or methylureido; imido, such as N-succinimido or 3-benzylhydantoinyl; sulfamoylamino, such as N,N-dipropylsulfamoylamino or N-methyl-N-decylsulfamoylamino; carbamoylamino, such as N-butylcarbamoylamino or N',N-dimethylcarbamoylamino; alkoxycarbonylamino, such as methoxycarbonylamino or tetradecyloxycarbonylamino; aryloxycarbonyl amino, such as phenoxycaronylamino, 2,4-di-t-butylphenoxycarbonylamino; sulfonamido, such as methanesulfonamido or hexadecanesulfonamido; carbamoyl group, such as N-ethylcarbamoyl or N,N-dibutylcarbamoyl; acyl, such as acetyl or (2,4-di-t-amylphenoxy)acetyl; sulfamoyl, such as N-ethylsulfamoyl or N,N-dipropylsulfamoyl; sulfonyl, such as methanesulfonyl or octanesulfonyl; sulfinyl, such as octanesulfinyl or dodecylsulfinyl; alkoxycarbonyl, such as methoxycarbonyl or butyloxycarbonyl; aryloxycarbonyl, such as phenyloxycarbonyl or 3-pentadecyloxycarbonyl; alkenyl; hydroxyl; amino; and carbonamido groups.

Preferably, in formula M, $R_1$ represents a tertiary alkyl group of 4 to 12 carbon atoms. Most preferably it represents t-butyl.

The ballast group. ($R_2$) is a group of such size and configuration that, in combination with the remainder of the molecule, provides the coupler, and the dye formed from it, with sufficient bulk and hydrophobicity that it is substantially non-diffusible from the layer in which it is coated in the photographic element. Representative ballast groups include alkyl or aryl groups containing 6 to 32 carbon atoms.

In one embodiment, the ballast ($R_2$) is defined by the structure shown in Formula B:

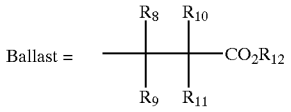

wherein $R_8$, $R_9$, $R_{10}$, $R_{11}$ are independently a hydrogen or a branched or unbranched, substituted or unsubstituted, alky, aryl, or heterocyclic group and $R_{12}$ is a branched or unbranched, substituted or unsubstituted, alky group. Suitably $R_8$, $R_9$, $R_{10}$, $R_{11}$, $R_{12}$ may be a group known in the art which typically promotes solubility, diffusion resistance, or dye stability of the dye formed upon reaction of the coupler with the oxidized color developing agent. Preferably $R_8$, $R_9$, $R_{10}$, $R_1$ are hydrogen or an unsubstituted alkyl or aryl groups and more preferably hydrogen or an unsubstituted alkyl groups and most preferably hydrogen or methyl or ethyl groups. Preferably $R_{12}$ is an unsubstituted branched or unbranched group and more preferably unsubstituted and branched or unbranched with from 6 to 20 carbons and most preferably unsubstituted branched or unbranched with from 12 to 18 carbons.

Other ballast groups include alkoxy, aryloxy, arylthio, alkylthio, alkoxycarbonyl, aryloxycarbonyl, carboxy, acyl, acyloxy, carbonamido, carbamoyl, alkylcarbonyl, arylcarbonyl, alkysulfonyl, arylsulfonyl, sulfamoyl, sulfenamoyl, alkylsulfinyl, arylsulfinyl, alkylphosphonyl, arylphosphonyl, alkoxyphosphonyl, arylsulfonamido, arylcarbonamido, aryloxycarbonylamino, heterocyclyl and arylphosphonyl groups.

The group represented by X can be a hydrogen atom or any of the coupling-off groups known in the art. Coupling-off groups can determine the equivalency of the coupler, can modify the reactivity of the coupler, or can advantageously affect the layer in which the coupler is coated or other layers in the element by performing, after the release from the coupler, such functions as development inhibition, development acceleration, bleach inhibition, bleach acceleration, color correction, and the like. Representative classes of coupling-off groups include halogen, particularly chlorine, bromine, or fluorine, alkoxy, aryloxy, heterocyclyloxy, heterocyclic, such as hydantoin and pyrazolo groups, sulfonyloxy, acyloxy, carbonamido, imido, acyl, heterocyclythio, sulfonamido, alkylthio, arylthio, heterocyclythio, sulfonamido, phosphonyloxy, and arylazo groups. Preferably, X is hydrogen or halogen. Most preferably, X is hydrogen or chlorine.

Specific couplers within the scope of the present invention have the following structures:

M-1

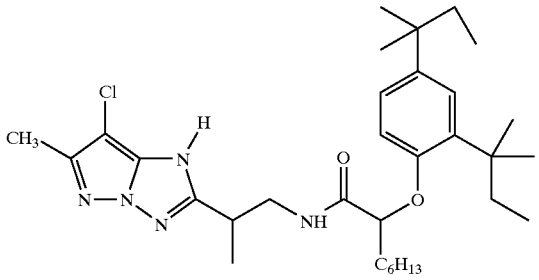

M-2

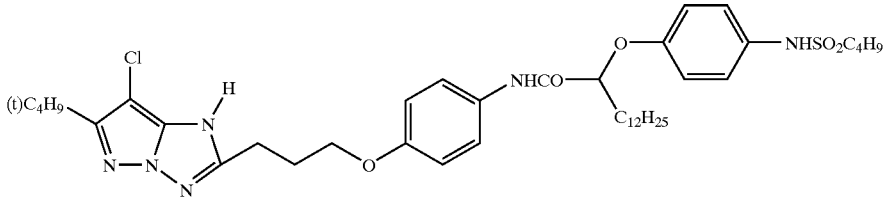

M-3

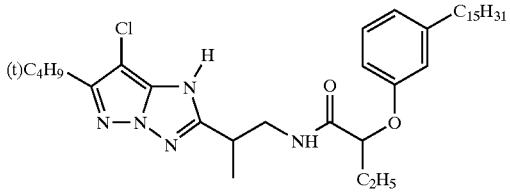

M-4

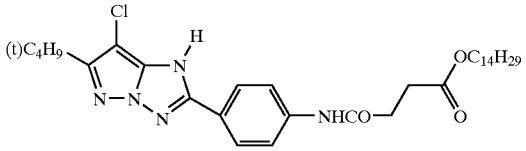

5
-continued
M-5
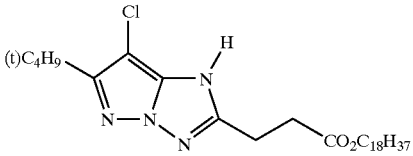
M-6
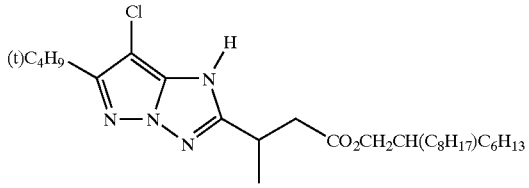
M-7
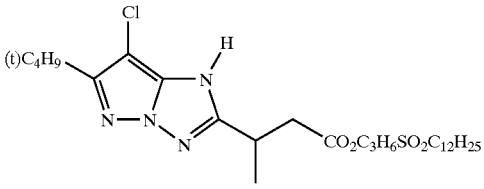
M-8
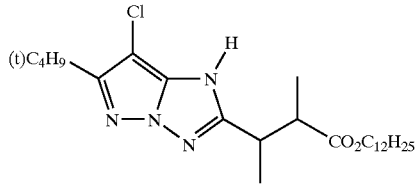
M-9
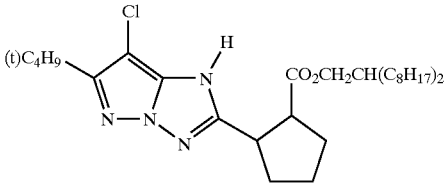
M-10
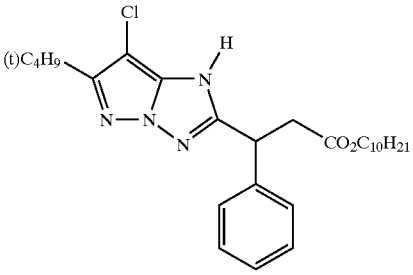
M-11
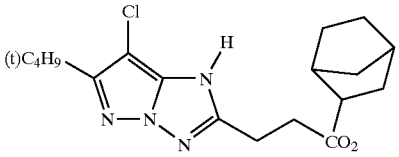
M-12
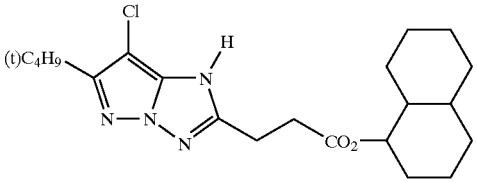
M-13
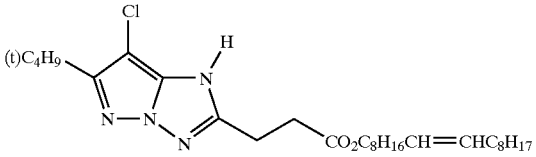
M-14
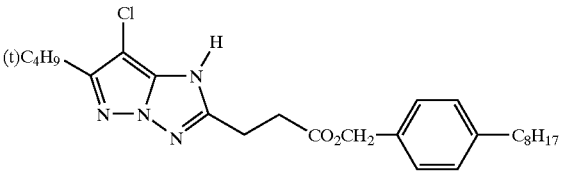
M-15
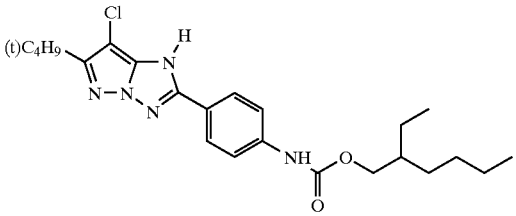
M-16
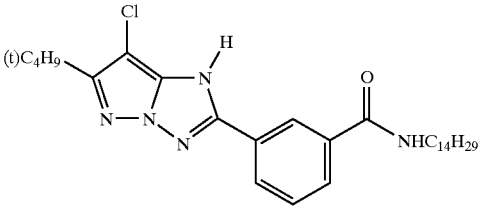
M-17
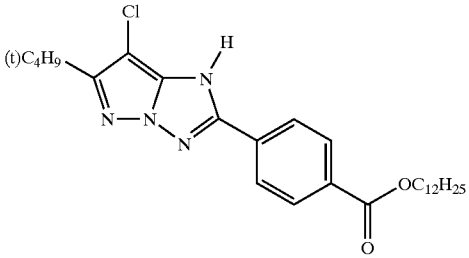
M-18
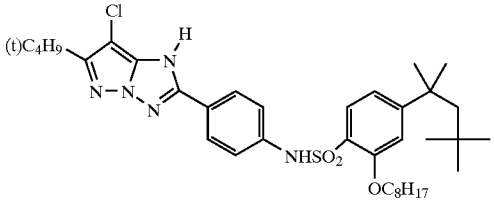
M-19
M-20

As an added advantage, the alkylsulfonamides useful in the invention are simple to prepare, often in one step, and cheaper than the corresponding aromatic sulfonamides.

The sulfonamide stabilizer compounds useful in the invention are free of direct aromatic linkage to either the sulfonamide nitrogen or sulfur. The sulfonamide stabilizer compound useful in the invention may be represented by formula I:

I

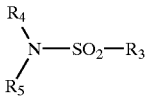

The sulfonamide substituents may be any substituents but typically include hydrogen and (cyclo)alkenyl or (cyclo) alkyl groups which may optionally be substituted with further substituents for example, with alkoxycarbonyl, thio, sulfoxy, sulfonamide, and carbonamido groups. Reference to "(cyclo)" is intended to mean, for example, that the alkyl group may be either cycloalkyl or an aliphatic (open chain) alkyl. Most preferably, $R_4$ and $R_3$ are (cyclo)alkyl or substituted (cyclo)alkyl and $R_5$ is hydrogen.

Specific stabilizers I within the scope of the invention have the following structures:

I-1

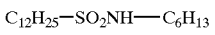

I-2

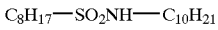

I-3

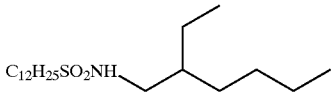

I-4

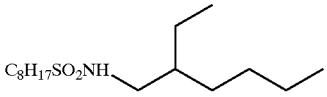

I-5

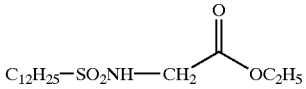

I-6

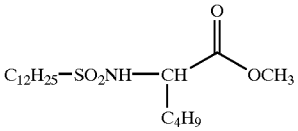

I-7

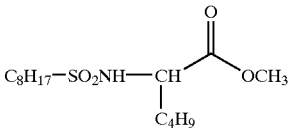

I-8

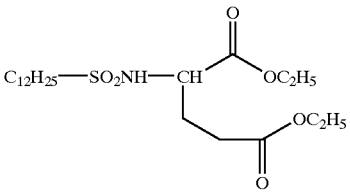

I-9

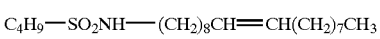

-continued

I-10

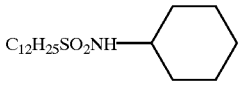

I-11

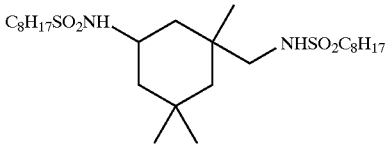

I-12

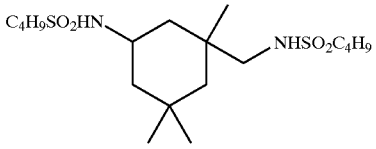

I-13

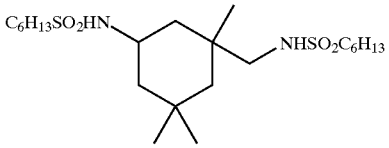

I-14

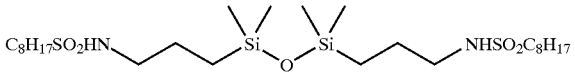

I-15

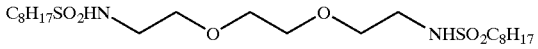

I-16

I-17

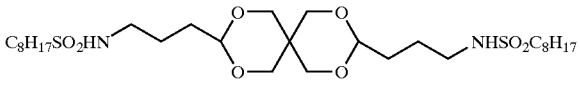

I-18

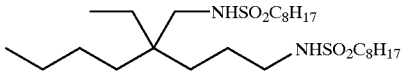

I-19

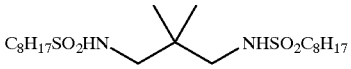

I-20

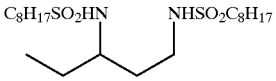

I-21

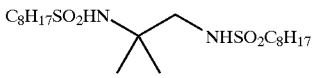

I-22

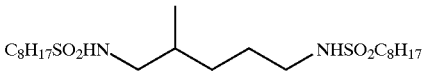

I-23

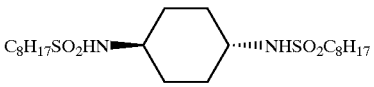

I-24

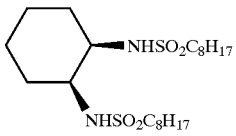

-continued

I-25

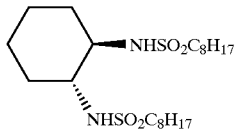

I-26

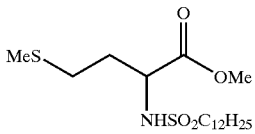

I-27

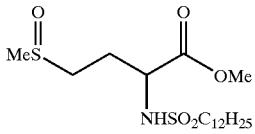

I-28 $C_{16}H_{33}SO_2NHCH_2CH_2OH$

I-29 $C_8H_{17}SO_2NHCH_2CH_2NHSO_2C_8H_{17}$

I-30

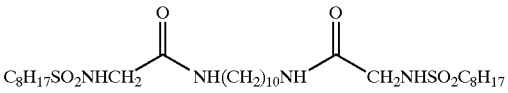

I-31

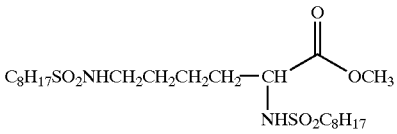

I-32

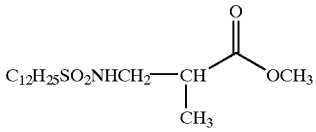

I-33

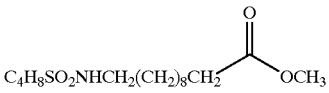

I-34

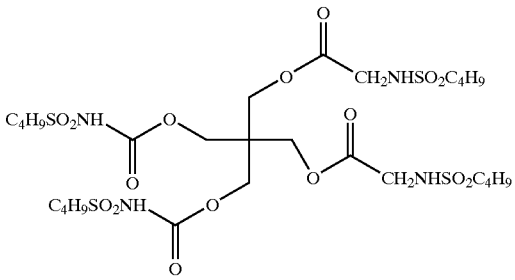

I-35

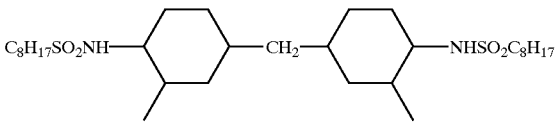

I-36

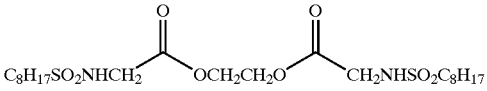

-continued

I-37

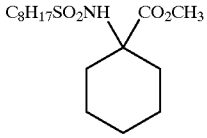

I-38

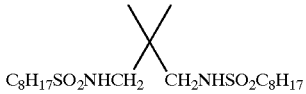

I-39

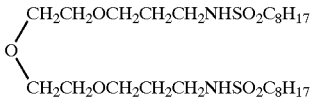

I-40

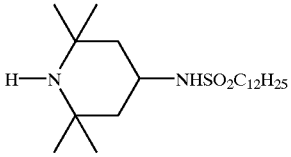

The compounds that have the formula S are believe to stabilize by acting as singlet oxygen quenchers or excited state quenchers. They are more particularly described as compounds of formula S:

S

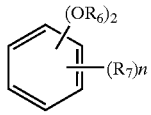

wherein each $R_6$ is an alkyl or alkenyl group of 1 to 30 carbon atoms;

each $R_7$ is a substituent and n is an integer of 0 to 4; and provided two $R_6$ groups or an $R_6$ and an $R_7$ group may join to form a carbocyclic ring and two $R_7$ groups may join to form a carbocyclic or heterocyclic ring.

Desirable are stabilizers of formula S wherein:

$R_6$ is an alkyl or alkenyl group of 1 to 16 carbon atoms;

$R_7$ is an alkyl or alkenyl group of 1 to 16 carbon atoms; and n is an integer of 2.

Also desired are structures of S wherein $R_6$ and $R_7$ or two $R_7$ groups are joined to form a carbocyclic ring.

The stabilizers of Formula S may contain two or more aryl groups individually represented by Formula S, in which case the said aryl groups may be joined by a covalent bond, a divalent linking group, a fused ring system, or a spiro ring system.

Specific stabilizers S within the scope of the invention have the following structures:

S-1
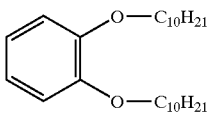
S-2
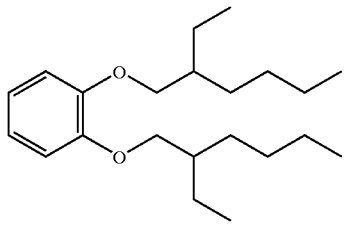
S-3
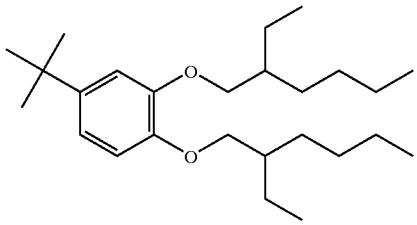
S-4
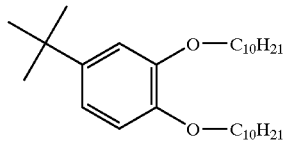
S-5
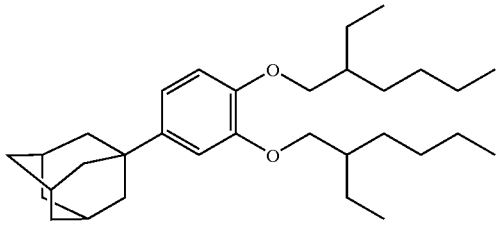
S-6
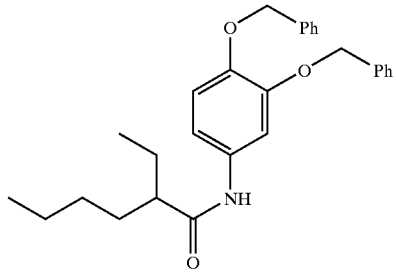
S-7
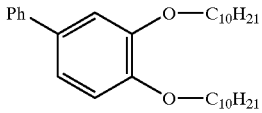
S-8
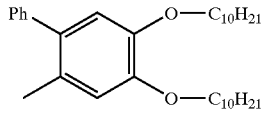
S-9
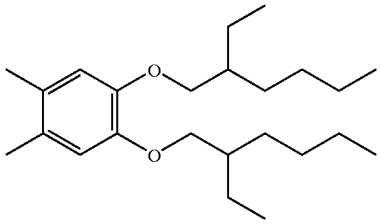
S-10
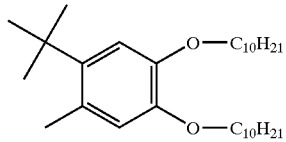
S-11
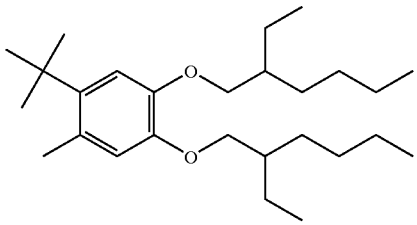
S-12
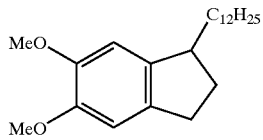
S-13
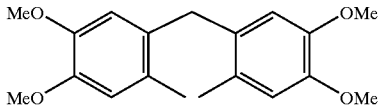
S-14
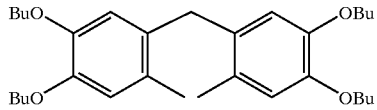
S-15
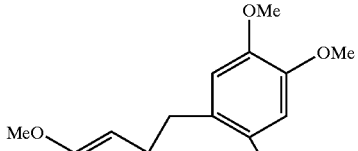
S-16
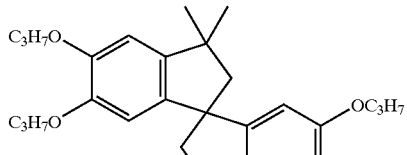

Throughout this application a reference to any type of chemical "group" or "compound" includes both the unsubstituted and substituted forms of the group or compound described. Generally, unless otherwise specifically stated, substituent groups usable on molecules herein include any groups, whether substituted or unsubstituted, which do not destroy properties necessary for the photographic utility. It will also be understood throughout this application that reference to a compound of a particular general formula includes those compounds of other more specific formula which specific formula falls within the general formula definition. Examples of substituents on any of the mentioned groups can include known substituents, such as: halogen, for example, chloro, fluoro, bromo, iodo; alkoxy, particularly those with 1 to 6 carbon atoms (for example, methoxy, ethoxy); substituted or unsubstituted alkyl, particularly lower alkyl (for example, methyl, trifluoromethyl); alkenyl or thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); and others known in the art. Alkyl substituents may specifically include "lower alkyl", that is having from 1 to 6 carbon atoms, for example, methyl, ethyl, and the like. Further, with regard to any alkyl group, alkylene group or alkenyl group, it will be understood that these can be branched or unbranched and include ring structures.

Typically, the couplers and the stabilizers with which they are associated are dispersed in the same layer of the photographic element in a high boiling organic compound known in the art as a coupler solvent. Representative coupler solvents include phthalic acid alkyl esters such as dibutyl phthalate, dioctyl phthalate, and diundecyl phthalate; phosphoric acid esters such as tricresyl phosphate, diphenyl phosphate, tris-2-ethylhexyl phosphate, and tris-3,5,5-trimethylhexyl phosphate; citric acid esters such as tributyl citrate and tributyl acetylcitrate; benzoic acid esters such as octyl benzoate;, aliphatic amides such as N,N-diethyl lauramide and N,N-dibutyl lauramide; dibasic aliphatic acid esters such as dibutyl sebacate; aliphatic alcohols such as oleyl alcohol; and alkyl phenols such as 2,4-di-t-butyl phenol. Especially preferred coupler solvents are the phthalate esters, which can be used alone or in combination with one another or with other coupler solvents. Selection of the correct coupler solvent has been found to have an influence both on the hue of the dye formed on coupling as well as on its stability.

The photographic elements of this invention can be black and white elements (for example, using magenta, cyan and yellow dye forming couplers), single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

Photographic elements of this invention can have the structures and components shown on Research Disclosure, February 1995, Item 37038, pages 79–114. Research Disclosure is published by Kenneth Mason Publications, Ltd., Dudley Annex, 12a North Street, Emsworth, Hampshire P010 7DQ, ENGLAND. Specific elements can be those shown on pages 96–98 of this Research Disclosure item as Color Paper Elements 1 and 2, in which is employed in the magenta dye forming layers the stabilizer combinations of the present invention instead of the stabilizers shown there. A typical multicolor photographic element of this invention comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support, which can be transparent or reflective (for example, a paper support). Photographic elements of the present invention may also usefully include a magnetic recording material as described in Research Disclosure, Item 34390, November 1992, or a transparent magnetic recording layer such as a layer containing magnetic particles on the underside of a transparent support as in U.S. Pat. No. 4,279,945 and U.S. Pat. No. 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

This invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

In the following discussion of suitable materials for use in elements of this invention, reference will be made to Research Disclosure, September 1994, Number 365, Item 36544, which will be identified hereafter by the term "Research Disclosure I." The Sections hereafter referred to are Sections of the Research Disclosure I.

The silver halide emulsions employed in the elements of this invention can be either negative-working, such as surface-sensitive emulsions or unfogged internal latent image forming emulsions, or direct positive emulsions of the unfogged, internal latent image forming type which are positive working when development is conducted with uniform light exposure or in the presence of a nucleating agent. Suitable emulsions and their preparation as well as methods of chemical and spectral sensitization are described in Sections I through V. Color materials and development modifiers are described in Sections V through XX. Vehicles which can be used in the elements of the present invention are described in Section II, and various additives such as brighteners, antifoggants, stabilizers, light absorbing and scattering materials, hardeners, coating aids, plasticizers, lubricants and matting agents are described, for example, in Sections VI through X and XI through XIV. Manufacturing methods are described in all of the sections, other layers and supports in Sections XI and XIV, processing methods and agents in Sections XIX and XX, and exposure alternatives in Section XVI.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117; UK Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; UK Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic elements may further contain other image-modifying compounds such as developer inhibitor releasing compounds (DIR's).

The elements of the present invention may be employed to obtain reflection color prints as described in Research Disclosure, November 1979, Item 18716, available from Kenneth Mason Publications, Ltd, Dudley Annex, 12a North Street, Emsworth, Hampshire P0101 7DQ, England, incorporated herein by reference. The emulsions and materials to form elements of the present invention may be coated on pH-adjusted support as described in U.S. Pat. No. 4,917,994; with epoxy solvents (EP 0 164 961); with additional stabilizers (as described, for example, in U.S. Pat. No. 4,346,165; U.S. Pat. No. 4,540,653 and U.S. Pat. No. 4,906,559); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805. Other compounds useful in the elements of the invention are disclosed in Japanese Published Patent Applications 83/09,959; 83/62,586; 90/072,629, 90/072,630; 90/072,632; 90/072,633; 90/072,634; 90/077,822; 90/078,229; 90/078,230; 90/079,336; 90/079,338; 90/079,690; 90/079,691; 90/080,487; 90/080,489; 90/080,490; 90/080,491; 90/080,492; 90/080,494; 90/085,928; 90/086,669; 90/086,670; 90/087,361; 90/087,362; 90/087,363; 90/087,364; 90/088,096; 90/088,097; 90/093,662; 90/093,663; 90/093,664; 90/093,665; 90/093,666; 90/093,668; 90/094,055; 90/094,056; 90/101,937; 90/103,409; 90/151,577.

The silver halide used in the photographic elements of the present invention may be silver iodobromide, silver bromide, silver chloride, silver chlorobromide, silver chloroiodobromide, and the like. The type of silver halide grains preferably include polymorphic, cubic, and octahedral. The grain size of the silver halide may have any distribution known to be useful in photographic compositions, and may be ether polydipersed or monodispersed. Particularly useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in microns and t is the average thickness in microns of the tabular grains.

The average useful ECD of photographic emulsions can range up to about 10 microns, although in practice emulsion ECD's seldom exceed about 4 microns. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin ($t<0.2$ micron) tabular grains. To achieve the lowest levels of granularity it is preferred to that aim tabular grain projected areas be satisfied with ultrathin ($t<0.06$ micron) tabular grains. Tabular grain thicknesses typically range down to about 0.02 micron. However, still lower tabular grain thicknesses are contemplated. For example, Daubendiek et al. U.S. Pat. No. 4,672,027 reports a 3 mole percent iodide tabular grain silver bromoiodide emulsion having a grain thickness of 0.017 micron.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions tabular grains satisfying the stated thickness criteria above account for at least 70 percent of the total grain projected area. In the highest performance tabular grain emulsions tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The silver halide grains to be used in the invention may be prepared according to methods known in the art, such as those described in Research Disclosure I and in T. H. James, "The Theory of the Photographic Process". These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in Research Disclosure I and the references cited therein.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in Research Disclosure I. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in Research Disclosure I. The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30 to 80° C., as illustrated in Research Disclosure, June 1975, item 13452 and U.S. Pat. No. 3,772,031.

The silver halide may be sensitized by sensitizing dyes by any method known in the art, such as described in Research Disclosure 1. The dye may be added to an emulsion of the silver halide grains and a hydrophilic colloid at any time prior to (e.g., during or after chemical sensitization) or simultaneous with the coating of the emulsion on a photographic element. The dye/silver halide emulsion may be mixed with a dispersion of color image-forming coupler immediately before coating or in advance of coating (for example, 2 hours).

Photographic elements of the present invention are preferably image wise exposed using any of the known techniques, including those described in Research Disclosure I, section XVI. This typically involves exposure to light in the visible region of the spectrum, and typically such exposure is of a live image through a lens, although exposure can also be exposure to a stored image (such as a computer stored image) by means of light emitting devices (such as light emitting diodes, and CRT).

Photographic elements comprising the composition of the invention can be processed in any of a number of well-known photographic processes utilizing any of a number of well-known processing compositions, described, for example, in Research Disclosure I, or in T. H. James, editor, The Theory of the Photographic Process, 4th Edition, Macmillan, New York, 1977. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog unexposed silver halide (usually chemical or light fogging), followed by treatment with a color developer. Preferred color developing agents are p-phenylenediamines. Especially preferred are: 4-amino N,N-diethylaniline hydrochloride, 4-amino-3-methyl-N,N-diethylaniline hydrochloride, 4-amino-3-methyl-N-ethyl-N-(b-(methanesulfonamido) ethylaniline sesquisulfate hydrate, 4-amino-3-methyl-N-ethyl-N-(b-hydroxyethyl)aniline sulfate, 4-amino-3-b-(methanesulfonamido)ethyl-N,N-diethylaniline hydrochloride and 4-amino-N-ethyl-N-(2-methoxyethyl)-m-toluidine di-p-toluene sulfonic acid.

Development is followed by bleach-fixing, to remove silver or silver halide, washing and drying. Bleaching and fixing can be performed with any of the materials known to be used for that purpose. Bleach baths generally comprise an aqueous solution of an oxidizing agent such as water-soluble salts and complexes of iron (III)(e.g., potassium ferricyanide, ferric chloride, ammonium or potassium salts of ferric ethylenediaminetetraacetic acid), water-soluble persulfates (e.g., potassium, sodium, or ammonium persulfate), and water-soluble dichromates (e.g., potassium, sodium, and lithium dichromate). Fixing baths generally comprise an aqueous solution of compounds that form soluble salts with silver ions, such as sodium thiosulfate, ammonium thiosulfate, potassium thiocyanate, sodium thiocyanate, and thiourea.

The stabilizers of this invention can be used in photographic elements that are intended to be processed in amplification processes that use developer/amplifier solutions described in U.S. Pat. No. 5,324,624, for example. When processed in this way, the low volume, thin tank processing system and apparatus described in U.S. patent application Ser. No. 08/221,711, filed Mar. 31, 1994, preferably is employed.

The coupler and stabilizer compounds of the present invention are known compounds and can be prepared by techniques known to those skilled in the art. References, which describe the preparation of the dye forming couplers, are the patents and published applications referred to above as describing these compounds, and references cited therein. The preparation of Stabilizer compounds S is described in U.S. Pat. No. 5,236,819 and references cited therein.

SYNTHETIC EXAMPLE A

Glycine ethyl ester hydrochloride (13.9 g; 0.1 moles) and triethylamine (20.2 g; 0.2 moles) were combined in dichloromethane (150 ml) under nitrogen and cooled in an ice bath. Dodecylsulfonyl chloride (26.9 g; 0.1 moles) dissolved in dichloromethane (50 ml) was added dropwise. When addition was complete, the ice bath was removed and the reaction mixture was stirred overnight at room temperature. The reaction mixture was quenched into water, additional dichloromethane was added and the layers separated. The organic layer was washed with brine, dried ($Na_2SO_4$) and freed of solvent under vacuum to afford a cream colored solid (26.6 g). The crude product was recrystallized from hexanes to afford the product as white crystals, mp. 58–60° C. $^1$H NMR (DMSO$d_6$): δ=0.8–0.9 (t, 3H,$CH_3$), 1.2–1.4 (m, 21H, $CH_2$, $CH_3$), 1.6–1.7 (m, 2H, $CH_2$), 3.0 (m, 2H, $CH_2S$), 3.8 (d, 2H, $CH_2$), 4.1–4.2 (q, 2H, $OCH_2$), 7.5–7.9 (t, 1H, NH).

SYNTHETIC EXAMPLE B

The same procedure utilizing glutamic acid diethyl ester hydrochloride and dodecylsulfonyl chloride, afforded 35% of the desired product as a light yellow oil after column chromatography (silica gel; $CH_2Cl_2$). $^1$H NMR ($CDCl_3$): δ=0.8–0.92 (t, 3H,$CH_3$), 1.2–1.5 (m, 24H, $CH_2$), 1.75–2.05 (m, 4H, $CH_2$), 2.45–2.55 (m, 2H, $CH_2$), 2.45–2.55 (m, 2H, $CH_2$), 4.1–4.3 (m, 5H, CH, $CH_2$), 5.0–5.05 (D, 1H, NH).

SYNTHETIC EXAMPLE C

The same procedure utilizing 2-ethylhexyl amine and dodecylsulfonyl chloride, afforded 66% of the desired product as a clear oil after column chromatography (silica gel; 20/80 hexanes/$CH_2Cl_2$). $^1$H NMR ($CDCl_3$): δ=0.8–0.95 (t, 9H,$CH_3$), 1.2–1.5 (m, 27H, $CH_2$), 1.75–1.88 (m, 2H, $CH_2$), 2.95–3.1 (m, 4H, $CH_2$) 4.2–4.3 (t, 1H, NH).

PHOTOGRAPHIC EXAMPLES

Coupler M4, first stabilizer S-16, second stabilizer I-8, and co-coupler solvents of equal amounts dibutyl sebacate (DBS) and tris(2-ethyl hexyl) phosphate (TEHP) were dispersed in aqueous gelatin in the following manner. Coupler M-4 (0.260 g, $4.4\times10^{-4}$ mole), first stabilizer S-16 (0.113 g, $2.22\times10^{-4}$ mol) and second stabilizer I-8 (0.409 g $9.39\times10^{4}$ mol) were dissolved in the co-solvents (1.040 g) and ethyl acetate (1.175 g). The mixture was heated to effect solution. After adding a solution of aqueous gelatin (13.17 g, 11.7% solution), surfactant Alkanol XC (trademark of E. I. Dupont Co.) (1.54 g, 10% solution), and water to make a total of 22.53 grams, the mixture was dispersed by passing it three times through a Gaulin homogenizer. This dispersion was used in the preparation of photographic element 101. Dispersions containing the co-stabilizers shown for elements in Table I were prepared in a similar manner except that the co-stabilizers indicated were added in the amounts shown.

The invention was evaluated in a single coupler containing coating consisting of 3 layers. Evaluations were made based on samples of these coatings.

The invention will be described in more detail using coating experiment 1, however the invention is not limited to this experiment. Experiment I was made by coating photosensitive emulsions on a resin-coated photographic support with 3.23-g/$m^2$(300 mg/sq ft) of gelatin as base. All stated amounts are in g per $m^2$.

| Experiment 1 | |
|---|---|
| 1st layer-Magenta Coupler Layer | |
| Gelatin | 134 mg/$ft^2$ (1.44 g/$m^2$) |
| Compound M-4 | 0.023 mmol |
| High Boiling Organic Solvent 1 (DBS) | 24 mg/$ft^2$ (0.258 g/$m^2$) |
| High Boiling Organic Solvent 2 (TEHP) | 24 mg/$ft^2$ (0.258 g/$m^2$) |
| Stabilizer S-16 | 5.85 mg/$ft^2$ (0.063 g/$m^2$) |
| Stabilizer I-8 | 21.24 mg/$ft^2$ (0.229 g/$m^2$) |
| Emulsion for Magenta Emulsion | 9.9 mg/$ft^2$ (0.107 g/$m^2$) |

-continued

| Experiment 1 | |
|---|---|
| (Fine Grain silver iodide emulsion, average equivalent grain size 0.64 μm) | |
| 2nd layer UV Absorbing Layer | |
| Gelatin | 130 mg/$ft^2$(1.399 g/$m^2$) |
| UV Absorbent 1 (UV944H) | 44.9 mg/$ft^2$ (0.483g/$m^2$) |
| 3rd Layer Protective Layer | |
| Gelatin | 130 mg/$ft^2$ (1.399 g/$m^2$) |
| Gel Harderning Compound BVSME | 2.25% of total gel |

Processed samples were prepared by exposing the coatings through a step wedge and processing as follows:

| Process Step | Time (min.) | Temp. (° C.) |
|---|---|---|
| Developer | 0.75 | 35.0 |
| Bleach-Fix | 0.75 | 35.0 |
| Waterwash | 1.50 | 35.0 |

The processing solutions used in the above process had the following compositions (amounts per liter of solution):

| Developer Composition | Amt |
|---|---|
| Triethanolamine | 12.41 g |
| Blankophor REU (trademark of Mobay Corp.) | 2.30 g |
| Lithium polystyrene sulfonate | 0.09 g |
| N,N-Diethylhydroxylamine | 4.59 g |
| Lithium sulfate | 2.70 g |
| 4-amino-3-methyl-N-ethyl-N-(2-methansulfonamidoethyl)-aniline-sesquisulfate hydrate | 5.00 g |
| 1-Hydroxyethyl-1,1-diphosphonic acid | 0.49 g |
| Potassium carbonate, anhydrous | 21.16 g |
| Potassium chloride | 1.60 g |
| Potassium bromide | 7.00 mg |
| pH adjusted to 10.4 at 26.7° C. | |
| Bleach-Fix | |
| Solution of ammonium thiosulfate | 71.85 g |
| Ammonium sulfite | 5.10 g |
| Sodium metabisulfite | 10.00 g |
| Acetic acid | 10.20 g |
| Ammonium ferric ethylenediaminetetra acetate | 48.58 g |
| Ethylenediaminetetraacetic acid | 3.86 g |
| pH adjusted to 6.7 at 26.7° C. | |

The preceding tables show the various combinations of stabilizers tested. Table 2 and 3, below, show the comparison co-stabilizers tested. Table I shows the effect on dye fade from a density of 1.0 resulting from using different ratios of the various co-stabilizers to the coupler.

COMPARISON AROMATIC STABILIZERS

C-1

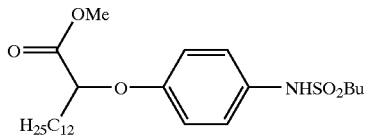

C-2

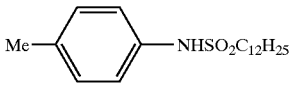

-continued

C-3

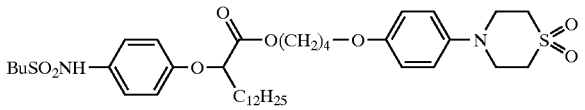

A comparison of light stability between an aromatic sulfonamide (C-1) and an alkylsulfonamide (I-8) at two different concentrations is shown in table 1. The mole ratios of stabilizer I to coupler are given in the table. The mole ratio of coupler to stabilizer S is 1:0.5. The density of each step of each strip was measured. The strips were then covered by UV-absorbing filters (in lieu of coating a similar filter layer over the photosensitive layer of the photographic element) and subjected to irradiation by the light of a xenon arc lamp at an intensity of 50,000 lux for 3 weeks. The light stability of the dye, expressed as the percent of the density of green light lost from an initial density of 1.0 is recorded. As can be seen, the alkylsulfonamides function in combination with stabilizers S to better protect the magenta dye from light fade.

TABLE 1

The comparison of light stability with aromatic sulfonamide (C-1) and alkylsulfonamide (I-8) with M-3 and S-16.

| Coupler | Stab S | Stab I (or C) | mole ratio | Dye loss 3 week HID | % loss |
|---|---|---|---|---|---|
| M-3 | S-16 | C-1 | 1.6 | −0.067 | 6.7 |
| M-3 | S-16 | I-8 (Inv) | 1.06 | −0.045 | 4.5 |
| M-3 | S-16 | C-1 | 3.4 | −0.084 | 8.4 |
| M-3 | S-16 | I-8 (Inv) | 2.12 | −0.053 | 5.3 |

Table 2 records the further results with a different magenta coupler (M4) and additional alkylsulfonamides. As shown in Table 2, the various alkylsulfonamides tested perform better than the comparative compounds (C-2 and C-3).

TABLE 2

The comparison of light stability with aromatic sulfonamides (C-2, 3) and alkylsulfonamides (I-4, 8, 18) with M-4 and S-16.

| Coupler | Stab S | Stab I (or C) | mole ratio | Dye loss 3 week HID | % loss |
|---|---|---|---|---|---|
| M-4 | S-16 | C-2 | 1.06 | −0.107 | 10.7 |
| M-4 | S-16 | C-2 | 2.12 | −0.106 | 10.6 |
| M-4 | S-16 | I-8 (Inv) | 1.06 | −0.080 | 8.0 |
| M-4 | S-16 | I-8 (Inv) | 2.12 | −0.055 | 5.5 |
| M-4 | S-16 | I-4 (Inv) | 1.06 | −0.089 | 8.9 |
| M-4 | S-16 | I-4 (Inv) | 2.12 | −0.071 | 7.1 |
| M-4 | S-16 | I-18 (Inv) | 0.53 | −0.082 | 8.2 |
| M-4 | S-16 | 1-18 (Inv) | 1.06 | −0.072 | 7.2 |
| M-4 | S-16 | C-3 | 1.06 | −0.116 | 11.6 |

Finally, table 3 records the results obtained by incorporating various dialkoxy aromatic stabilizers S. As can be seen, regardless of the stabilizers S employed, the alkylsulfonamide mixtures perform superior to those of the aromatic sulfonamides.

TABLE 3

The comparison of light stability with aromatic sulfonamide (C-1) and alkylsulfonamide (I-4, 8, 18) with M-4 and various stabilizers (S).

| Coupler | Stab S | Stab I (or C) | mole ratio | Dye loss 3 week HID | % loss |
|---|---|---|---|---|---|
| M-4 | S-25 | C-1 | 2.12 | −0.151 | 15.1 |
| M-4 | S-25 | I-8 (Inv) | 2.12 | −0.111 | 11.1 |
| M-4 | S-25 | I-18 (Inv) | 1.06 | −0.121 | 12.1 |
| M-4 | S-18 | C-1 | 2.12 | −0.144 | 14.4 |
| M-4 | S-18 | I-8 (Inv) | 2.12 | −0.110 | 11.0 |
| M-4 | S-19 | C-1 | 2.12 | −0.142 | 14.2 |
| M-4 | S-19 | I-4 (Inv) | 2.12 | −0.099 | 9.9 |
| M-4 | S-19 | I-18 (Inv) | 1.06 | −0.105 | 10.5 |
| M-4 | S-12 | C-1 | 2.12 | −0.174 | 17.4 |
| M-4 | S-12 | I-8 (Inv) | 2.12 | −0.124 | 12.4 |
| M-4 | S-27 | C-1 | 2.12 | −0.162 | 16.2 |
| M-4 | S-27 | I-8 (Inv) | 2.12 | −0.110 | 11.0 |

Mole ratio of coupler to Stabilizer S is 1:0.5.

The patents and other publications referred to in this description are incorporated herein by reference in their entirety.

What is claimed is:

1. A photographic element comprising a light-sensitive silver halide emulsion layer having associated therewith (a) a 1H-pyrazolo[1,5-b][1,2,4]triazole dye-forming coupler; (b) a sulfonamide compound free of aromatic substituents directly linked to the sulfonamide nitrogen or sulfur atoms and (c) a dialkoxy substituted aromatic compound.

2. The element of claim 1 wherein the sulfonamide compound is represented by Formula I:

I

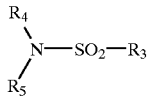

wherein $R_4$ and $R_3$ are independently selected (cyclo) alkyl or non-aromatic heterocyclic groups, and $R_5$ is hydrogen or a (cyclo)alkyl or non-aromatic heterocyclic group.

3. The element of claim 2 wherein each of $R_4$ and $R_3$ are independently selected (cyclo)alkyl groups.

4. The element of claim 3 wherein $R_4$ or $R_3$ contains an alkoxycarbonyl substituent.

5. The element of claim 2 wherein $R_5$ is hydrogen.

6. The element of claim 4 wherein $R_5$ is hydrogen.

7. The element of claim 1 wherein the dialkoxy aromatic compound is represented by Formula S:

S

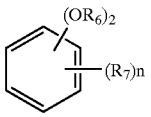

wherein each $R_6$ is an alkyl or alkenyl group of 1 to 30 carbon atoms; and each $R_7$ is a substituent and n is an integer of 0 to 4;

provided two $R_6$ groups or an $R_6$ and an $R_7$ group may join to form a carbocyclic ring and two $R_7$ groups may join to form a carbocyclic or heterocyclic ring.

8. The element of claim 7 wherein $R_6$ and $R_7$ join to form a carbocyclic ring.

9. The element of claim 7 wherein n is at least 2 and two $R_7$ groups join to form a carbocyclic ring.

10. The element of claim 1 wherein the dye formed by the coupler upon coupling with a p-phenylene diamine developer is magenta.

11. The element of claim 1 wherein the 1H-pyrazolo[1,5-b][1,2,4]triazole dye-forming coupler is represented by the Formula M:

M

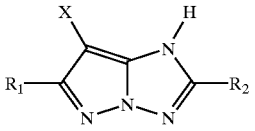

wherein $R_1$ and $R_2$ are substituent groups.

12. The element of claim 1 wherein the emulsion layer is sensitive to green light.

13. A method of forming an image in an element as described in claim 1 after the same has been imagewise exposed to light comprising contacting the element with a color developing compound.

14. The method of claim 13 wherein the developing compound is a p-phenylene diamine compound.

* * * * *